US008364605B2

(12) United States Patent
Rosenthal et al.

(10) Patent No.: US 8,364,605 B2
(45) Date of Patent: Jan. 29, 2013

(54) CALCULATING CONNECTIVITY, SOCIAL PROXIMITY AND TRUST LEVEL BETWEEN WEB USER

(75) Inventors: Tuvia Rosenthal, Herzeliya (IL); Erel Segal, Kiryat Haim (IL); Erez Segal, Kiryat Haim (IL)

(73) Assignee: Tros Interactive Ltd., Herzeliya (IL)

( * ) Notice: Subject to any disclaimer, the term of this patent is extended or adjusted under 35 U.S.C. 154(b) by 458 days.

(21) Appl. No.: 12/501,805

(22) Filed: Jul. 13, 2009

(65) Prior Publication Data

US 2010/0010826 A1 Jan. 14, 2010

Related U.S. Application Data

(60) Provisional application No. 61/080,254, filed on Jul. 13, 2008.

(51) Int. Cl.
*G06Q 99/00* (2006.01)

(52) U.S. Cl. ..... 705/319

(58) Field of Classification Search ..... None
See application file for complete search history.

(56) References Cited

U.S. PATENT DOCUMENTS

2004/0215793 A1* 10/2004 Ryan et al. ..... 709/229
2005/0197846 A1 9/2005 Pezaris
2005/0256866 A1* 11/2005 Lu et al. ..... 707/5
2006/0149708 A1 7/2006 Lavine
2007/0271379 A1* 11/2007 Carlton et al. ..... 709/225
2009/0222348 A1* 9/2009 Ransom et al. ..... 705/14
2010/0030734 A1* 2/2010 Chunilal ..... 707/3
2011/0007882 A1* 1/2011 Renero Quintero et al. ..... 379/90.01

* cited by examiner

*Primary Examiner* — Jonathan Ouellette
(74) *Attorney, Agent, or Firm* — Christopher Paul Mitchell

(57) ABSTRACT

A computer implemented system for, and a computer implemented method of calculating indicators to reflect real-life interactions between people, among those are connectivity, social proximity, best paths and trust level. The system comprises a server connected via a communication link to users associated with communication and web based environments and to the web based environments and communication platforms themselves. The server is arranged to receive data relating to users, their profiles, connections and related data in the communication and web based environments as well as large scale data from these environments. The server comprises an application arranged to convert the data into a standard numeric format quantifying the connectivity, the social proximity, the trust level and other indicators to reflect real-life interactions between people. The computer implemented method collects information about the users and their connectivity, and analysis and maps the information as a virtual network spanning a plurality of the web based environments and communication platforms.

16 Claims, 3 Drawing Sheets

CALCULATING CONNECTIVITY, SOCIAL PROXIMITY AND TRUST LEVEL BETWEEN WEB USER

CROSS REFERENCE TO RELATED APPLICATIONS

This application claims the benefit of U.S. Provisional Patent Application 61/080,254 filed on Jul. 13, 2008, which is incorporated herein by reference.

BACKGROUND

1. Technical Field

The present invention relates to the field of internet applications, and more particularly, to social networks and web based applications where users interact.

2. Discussion of Related Art

With the rise in social network usage, and increase interaction between users over the internet, the problem of communicating/interacting with a virtual stranger and finding trustable partners for dating, business or other social goals becomes more and more important. Social networks have a vast potential for creating new relationships between people, but the problems of fake identities and scammers cause distrust and block that potential from achieving full realization.

U.S. Patent Publication No. 20050197846, which is incorporated herein by reference in its entirety, discloses a method and system for generating a proximity index in a social networking environment, in which a first user defines relationships with a plurality of second users by assigning a relationship designator for each connection of a relationship. The first user stores content within the social networking environment and denotes individuals allowed to or prevented from accessing the content by entering one or more proximity thresholds. The social networking environment may generate a proximity index based on a variety of factors. The proximity index may be assigned a particular proximity index grouping depending upon a range in which a proximity index lies. The first user may control access to content and/or allow or prevent the reception and/or display of content from other users based on the other users' proximity index or proximity index grouping with respect to the first user. The user may further order a contact list based on proximity thresholds.

U.S. Patent Publication No. 20060149708, which is incorporated herein by reference in its entirety, discloses a search method and system using the same information regarding the structure of information in a content database is maintained in a structure database. The structure database is used to correlate the data structure of a query to the structure of the content database, in order to determine that information in the content database which needs to be provided to a searcher in response to the query. In one embodiment, this search method is used in an online forum, and the forum maintains a reputation score for users with respect to given subject matter. The reputation score is dependent upon the quality of a user's participation in the forum. A user's reputation score depends upon the evaluation by others of information he posts and upon the user evaluating information posted by others.

BRIEF SUMMARY

Embodiments of the present invention provide a computer implemented system for calculating connectivity, social proximity, trust level, best social paths and other indications between people using internet and communication platforms. One system comprises a server connected via a communication link to a plurality of users operatively associated with a social layer comprising at least one web based social environment and to at least one web based social environment or communication environment. The server comprises an application, a graphical user interface and a database, and is arranged to receive data relating to users, their profiles, connection and related data in the web based social environments as well as large scale data from the web based social environments. The application is arranged to convert the data into a standard numeric format quantifying the connectivity, the social proximity and the trust level in the social networks.

Embodiments of the present invention provide a computer implemented method of calculating connectivity, social proximity, best paths and trust level in social networks. One method comprises the stages: (i) collecting information related to users operatively associated with a social layer comprising at least one web based social environment, (ii) collecting acquaintance data relating to users of the social layer, (iii) converting the acquaintance data into a standard numeric format, (iv) calculating measures for connected users of the social layer, (v) generating at least one connection graph, a plurality of paths and at least one subjective network relating to the users of the social layer, (vi) adding information to the subjective networks, (vii) calculating measures for non connected users of the social layer, (viii) generating a virtual network spanning a plurality of the web based social environments, and (ix) upon query—responding to the query by using the subjective networks and caching calculated measures.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
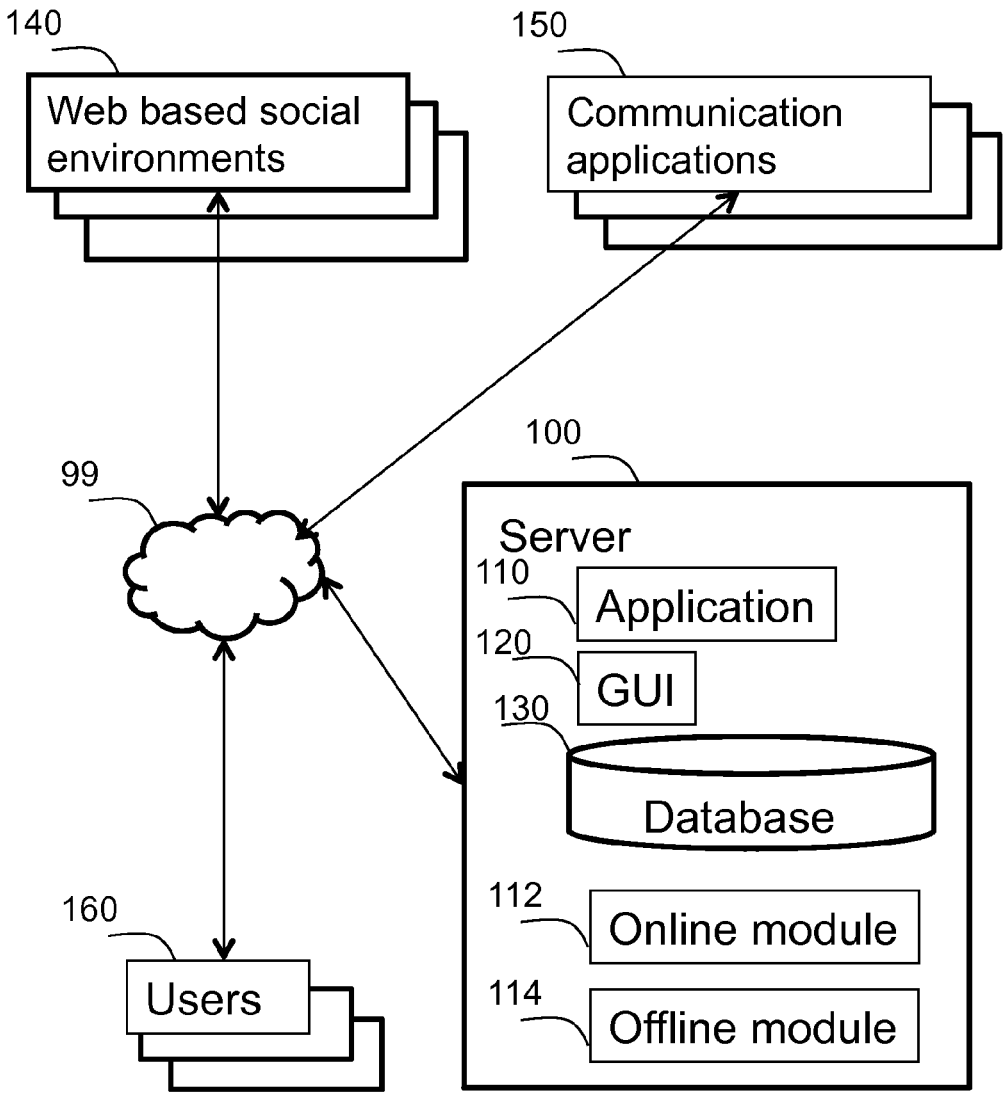
FIG. 1 is a high level schematic block diagram illustrating a data processing system for calculating connectivity, social proximity and trust level in social networks, according to some embodiments of the invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Embodiments of the present invention disclose a method and system for aggregating connectivity between users from various sources and creating a repository of the information in order to facilitate the calculation and measurement of some measures between any two users in the net. The method and system also calculate measures between members of social networks: social proximity and trust level.

For a better understanding of the invention, the usages of the following terms in the present disclosure are defined in a non-limiting manner:

The term "Social network" as used herein in this application, is defined as a directed graph of people, where each edge A→B denotes that person A directly linked to person B (e.g., knows him personally, communicates with him, etc). Each edge is marked with a description of the nature of the acquaintance—how A is connected to B, how long they know each other, etc.

The term "Social proximity" as used herein in this application, is defined as a function over ordered pairs of people in the virtual network, A and C, which measures the strength and proximity of the connection between person A to person C as it can be derived by the people and their links/connections in the virtual community. There is no need for a direct connection from person A to Person C The term "Trust level" as used herein in this application, is defined as a function over ordered pairs of people in a social network, A and C, which measures the amount of belief person A can have in person C's claims or judgment.

The term "Social path" as used herein in this application, is defined as a path in a graph of social network: a series of users $A_1 \rightarrow A_2 \rightarrow \ldots$. An where each user $A_i$ directly connected to user $A_i+1$ (i.e. $A_i$ knows user $A_i+1$ personally).

The term "Best social paths" as used herein in this application, is defined as a group of social paths between two people in the net, A and C, such that the combined strength per path of any two persons on these paths is the maximum possible in that network.

The term "Voucher" as used herein in this application, is defined as a person who can vouch for (tell about) another person, whom he/she knows personally.

The term "Best vouchers" as used herein in this application, is defined as a group of users that knows person C personally, such that the information that person A can get about person C by interrogating them is the maximum.

The term "Subjective network" as used herein in this application, is defined as a sub-graph of the social network graph that describes the network as a certain member (A) views it. The subjective network contains members of the social network that are socially closest to person A. It also contains values of the social proximity, trust level and other relevant measures, between person A and each other member in the network. A subjective network has a certain "radius", which is the length of the longest path from user A to a user in the network. For example, person A's subjective network of radius 2 contains all friends and friends of friends of person A, while A's subjective network of radius 3 contains friends of friends of friends as well.

The term "social connectivity" as used herein in this application, is defined as measure that represents the user's connectivity to the network by taking into account the number of connection he has, the strength of those connections, and, recursively, the social connectivity of those he is connected to.

The term "Social Layer" as used herein in this application, is defined as a computing system that holds and processes information of a unified virtual community. The system's repositories hold data and/or references to data about people and about the nature of connections among them. The data may be unified across several sources.

The term "Greater Network" as used herein in this application, is defined as a sub-graph of the social network graph that describes the entire connected network that is connected to a certain member (A). Any user B may be part of A's Greater network if, and only if, there is at least one Social Path that connects A with B.

The term "Social Proximity Service" as used herein in this application, is defined as a service provided by the Social Layer that calculates measures such as social proximity between users, social paths.

The term "web based social environment" as used herein in this application, comprises social networks, forums, professional sites and other applications that hold social information.

According to some embodiments, one system uses a repository of individuals, and a repository of social connections between individuals which contains among others, the existence of connection/s and the nature of the connection/s. For each member, the system calculates the subjective network—the social network that the member is part of and that is available for the member. In that network, the system calculates subjective measures such as the social proximity, trust level, best social paths, etc. to other members of the network. The calculation uses among others, graph-theory algorithms.

FIG. 1 is a high level schematic block diagram illustrating a data processing system for calculating connectivity, social proximity and trust level in social networks, according to some embodiments of the invention. The system comprises a server 100 connected via a communication link 99 to a plurality of users 160 operatively associated with a social layer comprising at least one web based social environment 140, to plurality of web based social environments 140 and to a plurality of communication applications 150. Server 100 comprises an application 110, a graphical user interface (GUI) 120 and a database 130. Server 100 receives data relating to users 160, their profiles, connection and related data in web based social environments 140 as well as large scale data from web based social environments 140. Users 160 are further prompted to fill questionnaires relating to their connections and contacts in real life and in web based social environments 140. Application 110 converts acquaintance data into a standard numeric format. Application 110 converts all acquaintance data from all sources into a standard numeric format that includes several measures, including the trust level and the acquaintance level between each two users that have any kind of direct connection between them. The system uses a genuine conversion formula that takes into account among others, the approximate number of interactions between the two users, the duration of their relationship, the nature of the interaction/s interaction, and other information.

According to some embodiments of the invention, server 100 may comprise an online module 112 arranged to update the data and related calculations substantially immediately after information changes, and an offline module 114 arranged to analyze the data and derived measures.

According to some embodiments of the invention, graphical user interface 120 may be arranged to allow users to input acquaintance data relating to them and other users.

According to some embodiments of the invention, application 110 may be further arranged to authenticate user identities, and to rate user credibility in a context of electronic commerce from the calculated measures in respect to other users.

According to some embodiments of the invention, server 100 may hold all relevant data or references to such data, and may provide a service to web based social environments 140 or users 160. This service allows users 160 to get measurement regarding another user which was previously unknown to them. Alternatively, server 100 may comprise a social network website, with an added value of showing social measures between members. Such social network site can have a specific domain. In particular a dating site based on this technology can be built to provide its users with the added benefit of better trust between its members. According to some embodiments of the invention, server 100 may comprise a cell-phone application or a hardware component that enables their owners to detect other, trustable people in their proximity.

According to some embodiments of the invention, communication applications 150 may comprise applications running on mobile devices (such as cell phones), email applications, etc. Communication applications 150 communicate with server 100 to enable further data collection about the users and the people in their proximity.

Figure 2:
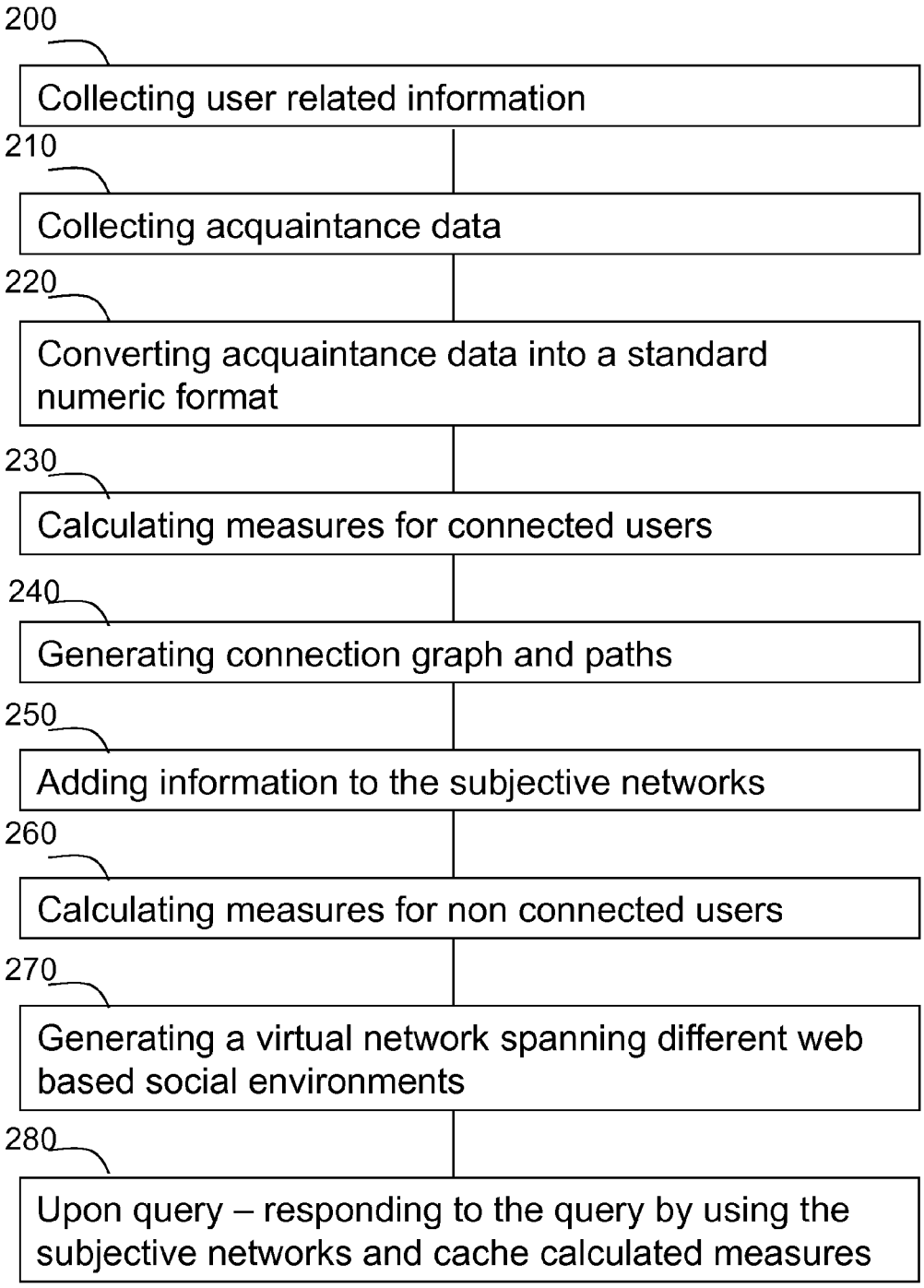
FIGS. 2 and 3 are high level flowcharts illustrating a computer implemented method of calculating connectivity, social proximity and trust level in social networks, according to some embodiments of the invention.
Figure 3:
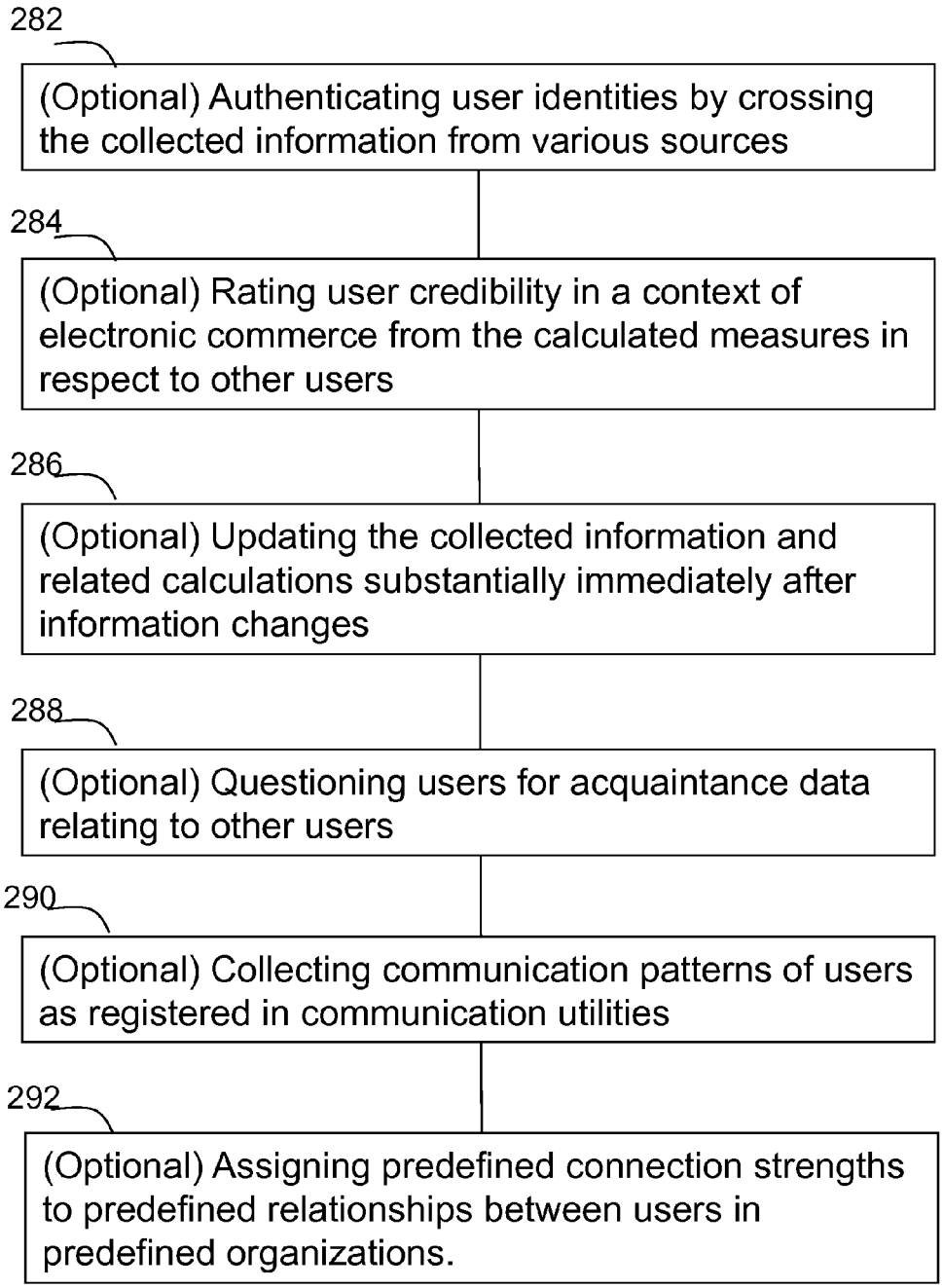

FIGS. 2 and 3 are high level flowcharts illustrating a computer implemented method of calculating connectivity, social proximity and trust level in social networks, according to some embodiments of the invention. The method comprises the following stages.

Collecting information related to users operatively associated with a social layer comprising at least one web based social environment (stage 200). Stage 200 may further comprise allowing users in web based social environments to register upon invitation from an inviter or upon self initiative, receiving connection details from users and their inviters and collecting information about the user, as well as receiving data from servers of the web based social environments and as information from predefined forms filled by any of the users.

Collecting acquaintance data (stage 210). Acquaintance data may comprise user data from different web based social environments, connections among users from different web based social environments, data entered by other users in different web based social environments, data from servers of the web based social environments, as well as information from predefined forms filled by any of the users.

Converting acquaintance data into a standard numeric format (stage 220). The system converts all acquaintance data from all sources into a standard numeric format that includes several measures, including the trust level and the acquaintance level between each two users that have any kind of direct connection between them. The system uses a genuine conversion formula that takes into account among others, the approximate number of interactions between the two users, the duration of their relationship, the nature of their interactions, and other information.

Calculating measures for connected users (stage 230). Measures may comprise social proximity, trust, paths and others. Stage 230 applies for connected users who are directly connected. The measures may be calculated in various ways among users, e.g., pair wise.

Generating connection graph, paths and subjective networks relating to the users of the social layer (stage 240). Paths may be generated in two phases—one at the data entry step—calculating for every user a network of distance k; and the second one during retrieval—calculating the network for the maximum desired distance, M, based on the previous calculations of sub network of radius k. in particular, the system and method may use in these phases radiuses k and M where k=M/2 to simplify the calculation process. According to some embodiments of the invention, stage 240 comprises calculating paths for a distance of k. The method expands the network of every user to a radius of k, which can be smaller then the maximum radius the method supports. For example, the method may calculate the network for a user to a radius of 2: For every ordered pair of users A and E such as there are users $B_1$, $B_2$, . . . $B_n$ where A is connected to $B_i$ and $B_i$ is connected with E, the method calculates the measures of Trust and Social proximity between A and E based on the N paths $A \rightarrow B_i \rightarrow E$. The method weighs all paths to one combined value, taking into account all weights of intermediate connections Adding information to the subjective networks (stage 250). According to some embodiments of the invention, all the calculated information is added to the subjective networks in the web based social environment. The new information is incorporated into the subjective networks of the relevant members.

Calculating measures for non connected users (stage 260). Measures may comprise social proximity, trust, paths and others. Stage 260 applies for users who are not connected (e.g., users in different web based social environments that are each connected to a user that is in all different web based social environments).

Generating a virtual network spanning different web based social environments (stage 270), based on data coming from different web based social environment to enable the calculation of proximity between users who did not originally reside in the same system.

Upon query—responding to the query by using the subjective networks and caching calculated measures (stage 280). Each member can query the database for measures relating him/her and other members in the network. According to some embodiments of the invention, to answer such queries, the system uses an online calculation to create the subjective network of distance 4 for the querying member. It does so by a genuine algorithm that combines many subjective networks of distance 2. The subjective network of distance 4 is then used to give the user an accurate and complete answer to his/her query. According to some embodiments of the invention, the calculation is split into two separate phases: phase one calculated following the data entry ("offline") and, phase two is calculated on data retrieval ("online"). This split balances between a small and manageable data repository and a fast and scalable response time for every request. Other external applications or users using other applications can use the Social Proximity service to obtain measures relating themselves and other users in the network. This can be performed assuming that these users have their relevant information and their network info stored in the Social Layer. The calculated information can be cached for a pre-determined period of time for reuse. The cache can be set to void after some time. Calculating the user's network up to the maximum radius of M can be cached together with all related information such as its trust and proximity measures to every (or some) of the users in that network. Subsequent queries that ask for information that was recently cached can be retrieved from this cache instead of being calculated again.

In the description above a radius of two was used in the calculation of the sub-networks in the first phase, and a maximum radius of four in the second phase. The invention does not limit itself to these distances. The system and method may calculate the measures for any maximum distance M, and to have a pre-calculation step for any distance d (where d<=M). When using d and M where M=2*d, the system and method may simplify the calculations. Using a maximum distance of 4 and pre-calculation for a distance of 2 was used in one of the implementation.

According to some embodiments of the invention, to register into the database, a person may receive an invitation from existing member/s who may know him/her from real life.

According to some embodiments of the invention, upon registration, both the new member and the inviting member may fill details about how the nature of connection between them. For example, the type of acquaintance, how long they know each other, etc.

According to some embodiments of the invention, the computer implemented method further comprises assigning predefined connection strengths to predefined relationships between users in predefined organizations (stage 292). According to some embodiments of the invention, a simple connection between users may be applied if they both belong to the same organization, such as employees of a specific company, students in the same academic institute, etc. For each such generic connection a default connection strength will be assigned to be used in calculating the various measures, A more specific strength factor can be used when there is more information regarding the connection within the organization, such as working on the same department or same location, graduating from same faculty or same year etc.

According to some embodiments of the invention, users can allow the system to collect and add information to the database also by retrieving their data, and data regarding their connections and connected persons, from other media platforms including but not limited to, social networking sites and applications thereof, personal sites, websites, email applications, phones, etc.

According to some embodiments of the invention, data from other repositories, including information regarding connectivity between users, can also be obtained from other systems on a large scale—that is, not on a per user basis, but rather a mass import of connection information, in cases where the repository holders wish to cooperate with us in order to obtain the benefits of our services.

According to some embodiments of the invention, the calculations may use persons whose data is not stored in the repository, but rather the system and method may only have information regarding their connection. For example, if persons A and C are both registered in our database, and person A know a person B, which is not registered in our database, and person C knows B as well, the system and method may derive a path A→B→C.

According to some embodiments of the invention, any path $A_1 \rightarrow A_2 \rightarrow \ldots$. An may not be valid and may be excluded from the various calculation, if the corresponding path $A_n \rightarrow \ldots A_2 \rightarrow A_1$ does not exist. According to some other embodiments of the invention, any such path may get a smaller weight when used in calculating the various measures.

According to some embodiments of the invention, the data about connections of registered persons and about the persons they connect with can be retrieved by crawling over public information published by web based environments.

According to some embodiments of the invention, the method may be repeated continuously, creating a database of members, acquaintance information and subjective networks. The offline calculation, described above, calculates subjective networks of distance k. (for example, if the system and method may takes k=2, for each user, the calculated subjective network includes his friends and friends of friends only). This pre-calculation for a partial distance (e.g., of two only and not for 4 or higher) is done in order to save storage space and calculation time, since a subjective network of distance 4 may include millions of users and updating such a network may have scalability limitations.

According to some embodiments of the invention, the users may add information and the method may get the information from other sources. The method may get the data from some of the sources and without the user's manual data entry. Data may be received in an arbitrary order. Connection details can be added between any two connected users. Connection info between users may be collected either from user or from other sources, e.g. web based social environments.

According to some embodiments of the invention, collecting information related to users (stage 200) may comprise questioning users for acquaintance data relating to other users (stage 288). According to some embodiments of the invention, collecting information related to users (stage 200) may comprise collecting communication patterns of users as registered in communication utilities (stage 290).

According to some embodiments of the invention, the input to the system is data about the acquaintance of people with other people, and the nature of their interaction The data can be collected in several ways: The data can be provided manually by the relevant people: The data may be entered in a human-friendly form—a user has to say how he knows other users, and provide additional information regarding their acquaintance: its duration, frequency of meetings, quality of connection and other related information that can help quantify the bond between the users; the system transforms this information to numeric information. According to some embodiments of the invention, data can be retrieved from data stores that hold information about users' relationship with other users, such as social networks, forums, professional sites etc. Data can be retrieved from communication utilities that hold information about the communication patterns of a user with other people. This information include, list of contacts, frequency and duration of communication, the context in which these communications took place and the content passed in these interactions.

According to some embodiments of the invention, the output of the system for a specific person A, can be used to differentiate between several levels of proximity and trust: (i) The highest level includes all users $B_i$ for which the system could calculate social proximity, trust, and/or other measures from A to them. (ii) The second level includes all users $C_i$ which are not in the first level and for which the system could verify that they are in the same Greater Network as user A. (iii) The third level includes all other users (i.e., not A and not in level 1 or 2). For every user $D_i$ on this level, user A may be advised to be more cautious since their connection could not be verified.

According to some embodiments of the invention, the output of the system is subjective—it is calculated personally for each pair of users, so that person A gets the above mentioned measures from his/her point of view. However, the trust level calculation also takes into account objective information about each member of the network. The system merges the subjective information with the objective information.

According to some embodiments of the invention, the objective information may include measurements which are not limited to a specific user point of view. An example of such measure can be the user's social connectivity.

According to some embodiments of the invention, the computer implemented method may further comprise updating the collected information and related calculations substantially immediately after information changes (stage 286). According to some embodiments of the invention, the calculations are done partially "offline" and partially "online": The offline calculations are done incrementally—when users change their social information related to other users, only the relevant parts of the calculation are re-executed. The online calculations are done when the information is requested.

According to some embodiments of the invention, the calculation can be performed for every pair in the combined data repository. To calculate the measurements between two users, the information regarding these users does not necessarily come from one source. Moreover, the information about other users and their connections, used to calculate the measurements and the paths, can originate from different sources that were all aggregated into the social layer.

According to some embodiments of the invention, the Social Proximity Service may be used to validate or authenticate users in various networks (social networks, websites and other applications). The users may be using their nick-names or their identifiers as they use in the respective web service and will use the System which will hold their real information in its repository, allowing it to find paths and other measures to selected other members, in the same, or other websites, even if those other members use nick-names or application identifiers instead of their real name.

According to some embodiments of the invention, it supports people in their decision making process of communicating via digital media with other people. It also allows the representation of people who are using the different means of the digital media in a social layer (unified virtual community). The invention provides indications that can be used by people to gauge other people (including those who are not directly connected to each other). The indications include, among others, Social proximity, Trust level, best social paths, best vouchers, and others. The invention provides outputs based on information that is gathered from the digital media, including but not limited to: social networking sites, websites, instant messaging applications, chat applications, email applications, mobile applications, MMS, SMS, TV broadcasting channels and all other communication platforms which can provide related information.

According to some embodiments of the invention, the present invention overcomes the problem of members of a social network having no way of knowing whether other members in the network are real people, fake profiles, or even criminals by allowing members of a social network to have valuable information about other members, before they even meet them. This enables members to feel more secure in meeting new people for dating, business, etc. Furthermore the present invention provides users with information about their acquaintances stored in various locations, creating a central repository that better reflects the user's real life connectivity to all of his/her acquaintances and would allow users to manage their connection data centrally. Finally having a combined Social Layer allow users to locate their friends' friends and rank them in one place, even if the information regarding their friends, and their friend's friends reside originally in separate unrelated systems.

According to some embodiments of the invention, main advantages of the proposed invention are: (i) It is much more difficult for a member to fake or alter artificially his/her trust level, (ii) the input to the system relies on and reflects real-life interactions and therefore is more user friendly, (iii) the output of the system is much more accurate and complete, (iv) a social proximity service also between people who are not directly connected or know each other from first hand does not exist in other solutions, (v) the network is updated and available in real time, (vi) the information can span across social networks and other data stores.

Specifically, according to some embodiments of the invention, while in other systems, members can artificially increase their trust level by inviting a lot of "fake friends", in the disclosed system it is not possible, because trust is calculated subjectively, so the fake trust of fake friends will only affect the fake friends themselves, and not other members that are not connected to them. While other systems ask users to fill an arbitrary number that should mark their "trust level", while the users don't have an objective way to calculate their "trust level" to other users—the disclosed system asks the members questions in human language, that they can answer objectively and clearly, e.g. "how do you know person B?", "how often do you meet?" etc. These questions are accompanied by a genuine formula that converts this verbal information to numeric information, that can be further processed by the social layer.

According to some embodiments of the invention, the accuracy and completeness of the invention result from the following characteristics: (i) The system and method use information gathered from members up to distance 4 from the source user, which means there are many possible paths (instead of using information from direct connection only). (ii) The system and method try to take into account all or most of the possible paths between the users instead of a single path only. (iii) The system and method take into account the nature of the connections between users and weight them, and not just finds available paths.

According to some embodiments of the invention, the computer implemented method may further comprise the following stages: Authenticating user identities by crossing the collected information from various sources (stage 282); and rating user credibility in a context of electronic commerce from the calculated measures in respect to other users (stage 284). According to some embodiments of the invention, the system and method may further be utilized to rate users in interactive systems, to enable better trust in email communication and to enable trust between buyers and sellers in e-commerce sites.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A data processing system for calculating connectivity, social proximity and trust level in social networks, the data processing system comprising:

a server comprising an application, a graphical user interface and a database, the server connected via a communication link to a plurality of users operatively associated with a social layer comprising at least one web based social environment, and the server further connected via the communication link to the at least one web based social environments, wherein the users have profiles, connection and related data in the web based social environments, wherein the server is arranged to receive data relating to the users, their profiles, connections and related data in the web based social environments as well as large scale data from the web based social environments, and wherein the application is arranged to convert the data into a standard numeric format quantifying the connectivity, the social proximity and the trust level in the social networks for connected users based upon number of interactions between the connected users, duration of their relationship, and nature of their interactions.

2. The data processing system of claim 1, wherein the user interface is arranged to allow users to input acquaintance data relating to them and other users.

3. The data processing system of claim 1, wherein the application is further arranged to authenticate user identities.

4. The data processing system of claim 1, wherein the application is further arranged to rate user credibility in a context of electronic commerce from the calculated measures in respect to other users.

5. The data processing system of claim 1, wherein the data is collected from social networking sites, websites, instant messaging applications, chat applications, email applications, mobile applications, MMS, SMS, and TV broadcasting channels.

6. The data processing system of claim 1, wherein the server comprises an online module arranged to update the data and related calculations substantially immediately after information changes, and an offline module arranged to analyze the data and derived measures.

7. A computer implemented method of calculating connectivity, social proximity and trust level in social networks, the method comprising:

collecting information related to users operatively associated with a social layer comprising at least one web based social environment;

collecting acquaintance data relating to users of the social layer by questioning users for acquaintance data relating to other users;

converting the acquaintance data into a standard numeric format;

calculating measures for connected users of the social layer quantifying the connectivity, the social proximity and the trust level based upon number of interactions between the connected users, the duration of their relationship, and the nature of their interactions;

generating at least one connection graph, a plurality of paths and at least one subjective network relating to the users of the social layer;

adding information to the subjective networks;

calculating measures for non connected users of the social layer;

generating a virtual network spanning a plurality of the web based social environments; and upon query—responding to the query by using the subjective networks and caching calculated measures.

8. The computer implemented method of claim 7, further comprising authenticating user identities by crossing the collected information from various sources.

9. The computer implemented method of claim 7, further comprising rating user credibility in a content of electronic commerce from the calculated measures in respect to other users.

10. The computer implemented method of claim 7, wherein the information is collected from social networking sites, websites, instant messaging applications, chat applications, email applications, mobile applications, MMS, SMS, and TV broadcasting channels.

11. The computer implemented method of claim 7, wherein the calculating measures for connected users of the social layer is carried out pair wise.

12. The computer implemented method of claim 7, wherein the collected information comprises measures relating to a single user.

13. The computer implemented method of claim 12, wherein the measures relating to a single user comprise a user's social connectivity.

14. The computer implemented method of claim 7, further comprising updating the collected information and related calculations substantially immediately after information changes.

15. The computer implemented method of claim 7, wherein collecting information related to users comprises collecting communication patterns of users as registered in communication utilities.

16. The computer implemented method of claim 7, further comprising assigning predefined connection strengths to predefined relationships between users in predefined organizations.

* * * * *